US008161694B1

(12) United States Patent
Frost

(10) Patent No.: US 8,161,694 B1
(45) Date of Patent: Apr. 24, 2012

(54) BURIAL CRYPT FOR CREMAINS AND METHOD OF FABRICATION

(76) Inventor: Lawrence E. Frost, Levant, ME (US)

( * ) Notice: Subject to any disclaimer, the term of this patent is extended or adjusted under 35 U.S.C. 154(b) by 0 days.

(21) Appl. No.: 13/014,786

(22) Filed: Jan. 27, 2011

(51) Int. Cl.
*E04H 13/00* (2006.01)

(52) U.S. Cl. ..... 52/142; 52/128; 52/134; 52/135; 52/136; 52/140

(58) Field of Classification Search ..... 52/128, 52/129, 131–142
See application file for complete search history.

(56) References Cited

U.S. PATENT DOCUMENTS

| | | | | | |
|---|---|---|---|---|---|
| 1,355,122 | A | * | 10/1920 | Bintliff | 264/34 |
| 1,959,773 | A | * | 5/1934 | Van Ness | 52/128 |
| 2,155,823 | A | * | 4/1939 | Hamlin et al. | 52/284 |
| 3,093,097 | A | * | 6/1963 | Rosenfeld | 109/1 S |
| 3,251,159 | A | * | 5/1966 | Trice | 52/20 |
| 3,295,271 | A | * | 1/1967 | Dorris | 52/124.1 |
| 3,642,339 | A | * | 2/1972 | Ruderfer | 312/283 |
| 3,897,663 | A | * | 8/1975 | Gaul | 52/136 |
| 4,121,390 | A | | 10/1978 | Hall et al. | |
| 4,128,981 | A | * | 12/1978 | Juba | 52/309.3 |
| 4,648,219 | A | * | 3/1987 | Johnston, Sr. | 52/131 |
| 4,709,120 | A | * | 11/1987 | Pearson | 174/16.1 |
| 4,804,307 | A | * | 2/1989 | Motoda | 414/282 |
| 4,961,293 | A | | 10/1990 | House et al. | |
| 5,081,802 | A | | 1/1992 | Westhoff et al. | |
| 5,383,311 | A | | 1/1995 | Strickland | |
| 5,608,998 | A | | 3/1997 | Hume | |
| 5,746,030 | A | | 5/1998 | Sannipoli, Sr. | |
| 5,791,098 | A | * | 8/1998 | Thomas | 52/169.6 |
| 5,894,699 | A | * | 4/1999 | Fulton et al. | 52/132 |
| 5,953,866 | A | * | 9/1999 | Poole | 52/169.6 |
| 6,105,315 | A | * | 8/2000 | Stoecklein et al. | 52/134 |
| 6,161,345 | A | * | 12/2000 | Hope et al. | 52/169.6 |
| 6,195,944 | B1 | | 3/2001 | Goldthorpe | |
| 6,196,761 | B1 | * | 3/2001 | Stanton et al. | 405/53 |
| 6,223,475 | B1 | * | 5/2001 | Hume | 52/21 |
| 6,340,269 | B1 | * | 1/2002 | Stanton et al. | 405/53 |
| 6,370,745 | B1 | * | 4/2002 | Kele et al. | 27/35 |
| 6,401,400 | B1 | * | 6/2002 | Elliott | 52/20 |
| 6,401,759 | B1 | | 6/2002 | Kamiyama et al. | |
| 6,637,976 | B2 | * | 10/2003 | Stanton | 405/53 |
| 6,899,240 | B2 | * | 5/2005 | Dang et al. | 220/3.8 |
| 7,337,585 | B1 | * | 3/2008 | Bobbit | 52/128 |
| 7,428,800 | B1 | | 9/2008 | Vaughn et al. | |
| 7,530,149 | B1 | * | 5/2009 | Bobbitt | 27/30 |
| 8,006,355 | B1 | * | 8/2011 | Bobbitt | 27/30 |
| 2002/0064425 | A1 | * | 5/2002 | Stanton | 405/53 |
| 2003/0145533 | A1 | * | 8/2003 | Dudek et al. | 52/128 |
| 2007/0251159 | A1 | * | 11/2007 | Wagner | 52/19 |
| 2008/0196327 | A1 | * | 8/2008 | Martin | 52/136 |

* cited by examiner

*Primary Examiner* — Mark Wendell
(74) *Attorney, Agent, or Firm* — Anthony D. Pellegrini

(57) ABSTRACT

An improved burial crypt for cremains designed to be placed below grade within a standard cemetery burial plot, suitable for containing a plurality of burial urns; the crypt comprised of a container, an access means, and a support means, with the container being sealable, substantially water tight, and fabricated of precast concrete walls, the access means being located within the interior of the container and suitably adapted to allow a human to descend into and ascend out of the container, and the support means being located within the interior of the container and suitably adapted to support a plurality of burial urns; and a method of fabrication of same.

20 Claims, 8 Drawing Sheets

BURIAL CRYPT FOR CREMAINS AND METHOD OF FABRICATION

BACKGROUND OF THE INVENTION

1. Technical Field

The invention relates generally to the field of the burial of human remains. More specifically, the invention is directed to an improved burial crypt for cremains designed to be placed within a standard cemetery burial plot and a method for fabrication of same.

2. Description of Prior Art

People have many options and choices of what to do with their remains and deciding on their final resting place. Direct burial has traditionally been the most common option, with the deceased being placed in a casket and the casket being buried below grade in a cemetery. Other modes of interment include placing a body in a casket within an above-ground crypt or in a wall tomb. While common, such traditional direct burials have the disadvantage of requiring substantial space for the casket. With regard to in-ground burial, there is a growing shortage of cemetery space, especially in urban areas.

An ever more common alternative to direct burial is cremation, whereby the remains of the deceased are placed in a wooden box and then burned at a high temperature, resulting in a small volume of end product known as cremains. Cremains are commonly stored in urns, though other dispositions are also practiced, such as scattering of the cremains into the environment. Burying the cremains (within an urn) in a cemetery is also an option.

The burial of cremains in a cemetery typically involves placing the urn containing the cremains into a cremation burial vault, which is a container meant to protect the urn when it is buried underground. However, cemetery burial plots for cremains typically are the same dimension as plots for direct burial of caskets. Even where smaller plots are designated for the burial of cremains, they still require a substantial amount of space for the cremation burial vaults. Such burial methods thus do not address the issue of the growing shortage of cemetery space.

It is therefore shown that there is a need for more efficient use of cemetery burial space with regard to the burial of cremains.

It is thus an object of the present invention to provide an improved burial crypt for cremains for use in cemeteries.

It is a further object of the present invention to provide an improved burial crypt for cremains that can contain a large number of cremation urns within an environmentally sealed subterranean structure.

It is yet a further object of the present invention to provide an improved burial crypt for cremains that can contain cremation urns without need for independent cremation burial vaults for said cremation urns.

It is yet a further object of the present invention to provide an improved burial crypt for cremains that can be fit into a standard cemetery plot.

It is yet a further object of the present invention to provide an improved burial crypt for cremains that can be easily accessed for the placement or removal of cremation urns over time.

It is yet a further object of the present invention to provide an improved burial crypt for cremains that is inexpensive to manufacture.

It is yet a further object of the present invention to provide an improved burial crypt for cremains that can be assembled on site.

It is yet a further object of the present invention to provide a method of fabrication of an improved burial crypt for cremains.

Other objects of the present invention will be readily apparent from the description that follows.

SUMMARY OF THE INVENTION

The present invention comprises an improved burial crypt for cremains suitably adapted to be placed below grade in a standard single or double cemetery plot. The crypt is formed of precast concrete, is water tight, lined, sealable, and comprises an access means for allowing persons to enter into and exit from its interior. Within the interior are support means adapted to support a multiplicity of burial urns. The crypt is designed to be assembled on site.

The improved burial crypt of the present invention is configured as a six sided rectangular structure having substantially parallel pairs of opposing planar side walls and a top wall and a bottom wall which are substantially planar and parallel to each other, with the top and bottom walls substantially perpendicular to the side walls and pairs of adjacent side walls substantially perpendicular to each other. The dimensions of the improved burial crypt are approximately ten (10) feet wide by approximately ten (10) feet long by approximately eight (8) feet tall, for use with a standard single cemetery plot, or approximately ten (10) feet wide by approximately twenty (20) feet long by approximately eight (8) feet tall, for use with a standard double cemetery plot. Actual dimensions may be somewhat smaller to allow for a buffer between plots. Other dimensions may also be used, as appropriate.

The improved burial crypt is assembled on site from precast walls which are manufactured off site. Access into the interior may be achieved through an integrated precast riser and hatch formed into the top wall. Prior to transport and assembly the precast walls may have a liner formed onto the inner surfaces of each said wall. During assembly sealants may be applied to the joints between said walls. The access means may also be integrated into one of said side walls, or it may be an independent removable structure, such as a ladder.

The method of fabrication of the improved burial crypt involves the following steps: fabricating components of the crypt at a site located distant from the final location of the crypt; transporting the components of the crypt to the final location of the crypt; placing the components of the crypt into an excavated site; partially assembling the components of the crypt; placing within the interior of the partially assembled crypt an access means, said access means suitably adapted to allow a human to descend into and ascend out of said interior of the crypt; placing within the interior of the partially assembled crypt a support means, said support means suitably adapted to support a plurality of burial urns; further assembling the crypt; and providing fill around and onto the crypt until it is buried substantially below grade.

Other features and advantages of the invention are described below.

DETAILED DESCRIPTION OF THE INVENTION

Figure 2:
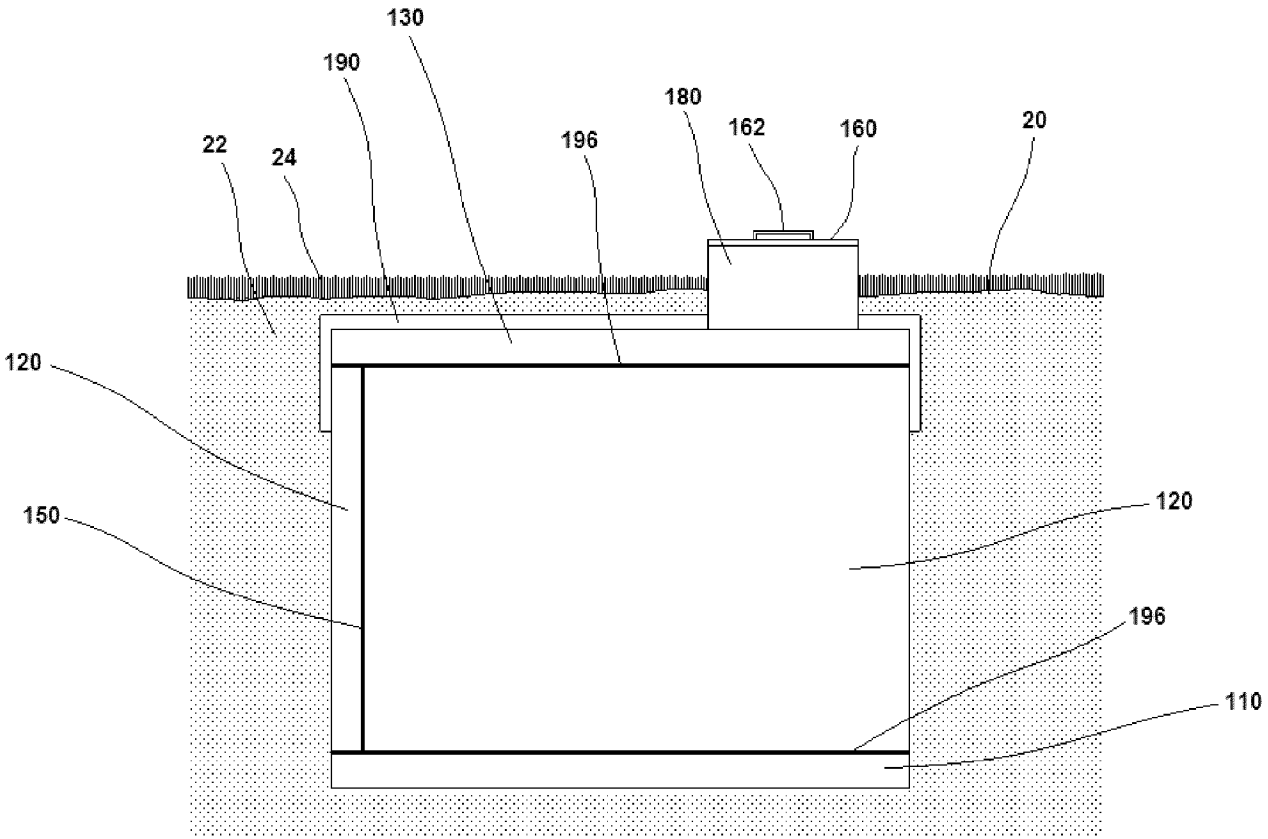
FIG. 2 is a plan side view of the improved burial crypt of the present invention, oriented ninety degrees from the view of FIG. 1, further depicting the improved burial crypt buried below grade in the earth.
Figure 3:
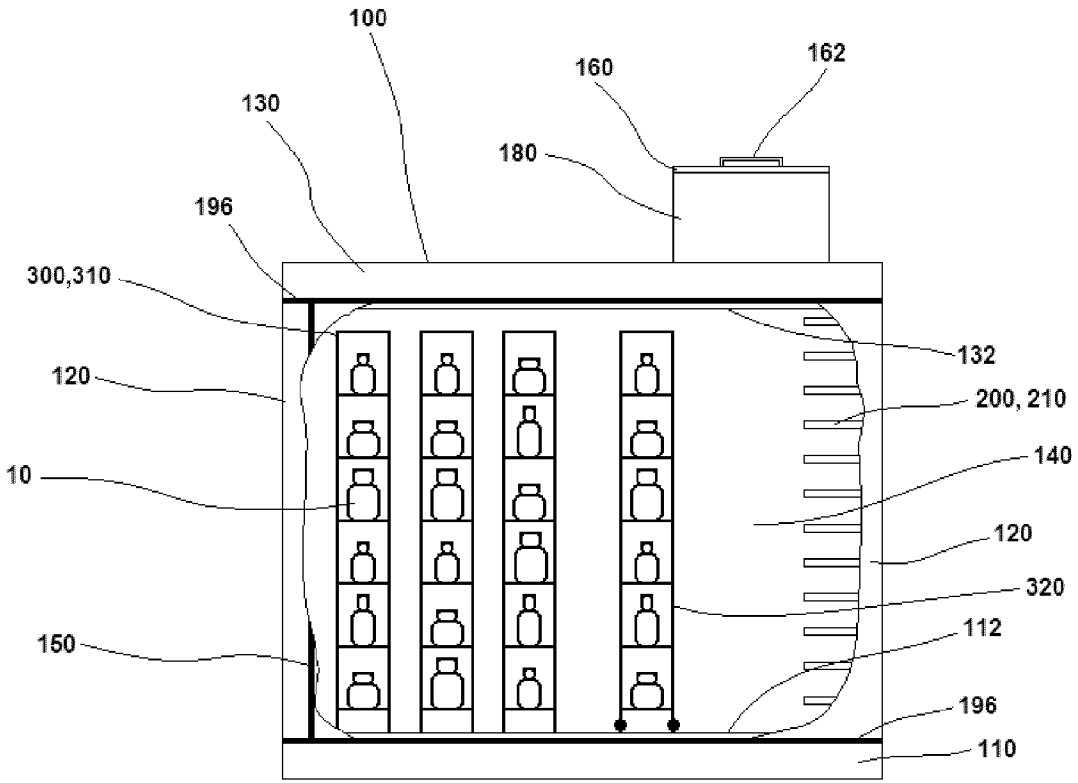
FIG. 3 is a plan side view of the improved burial crypt of FIG. 2, with the near side wall cut away to show the interior of the crypt containing the support structures and the access means.

The present invention comprises an improved subterranean crypt 1 suitable for placing below grade 20 in a standard single or double cemetery plot and further suitable for containing a plurality of burial urns 10. The improved crypt 1 comprises a container 100, an access means 200, and a support means 300. See FIG. 3. The container 100 is sealable, substantially water tight, and suitably adapted to be placed substantially below grade 20. See FIG. 2. The access means 200 is located within the interior 140 of the container 100 and is suitably adapted to allow a human to descend into and ascend out of the interior 140 of the container 100. The support means 300 is also located within the interior 140 of the container 100 and is suitably adapted to support a plurality of burial urns 10. See FIG. 3.

Figure 1:
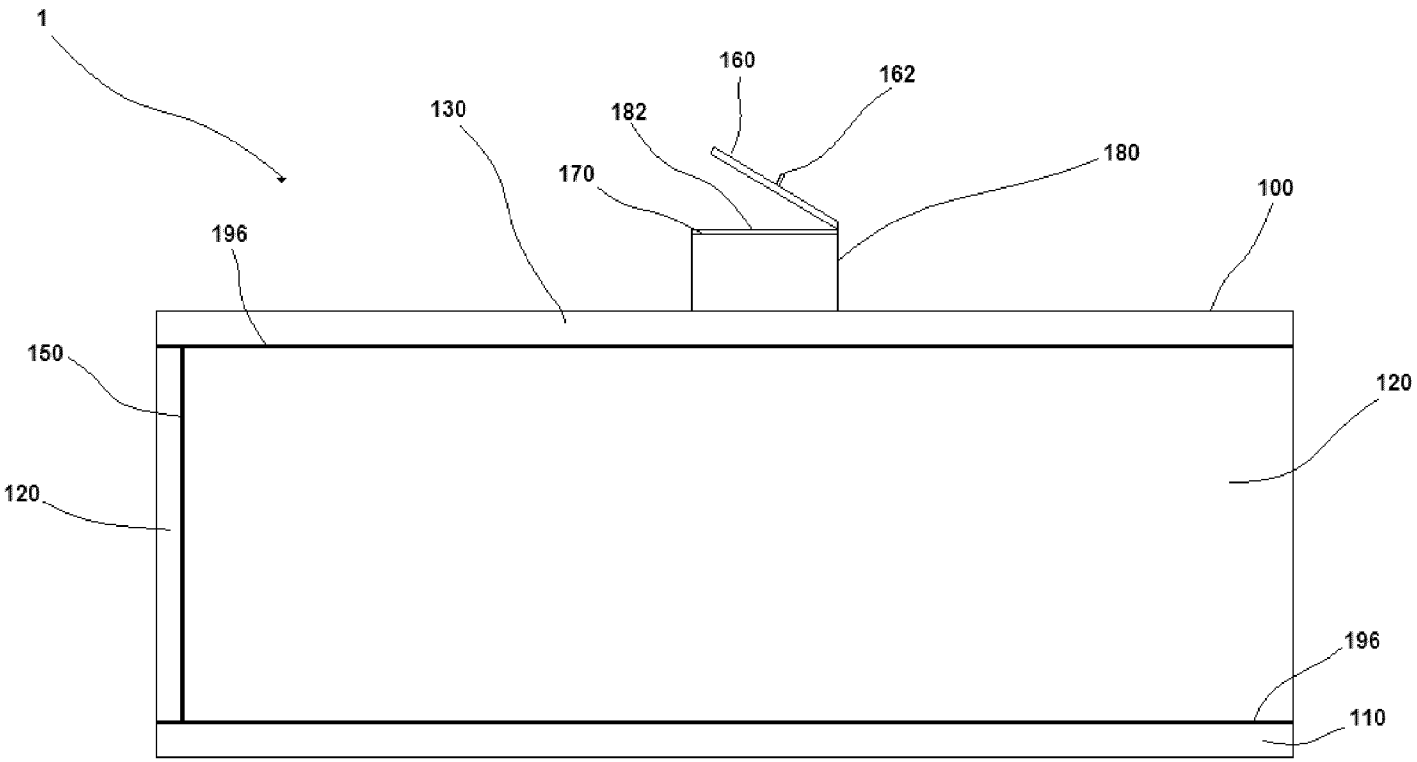
FIG. 1 is a plan side view of the improved burial crypt of the present invention with partially opened hatch.
Figure 4:
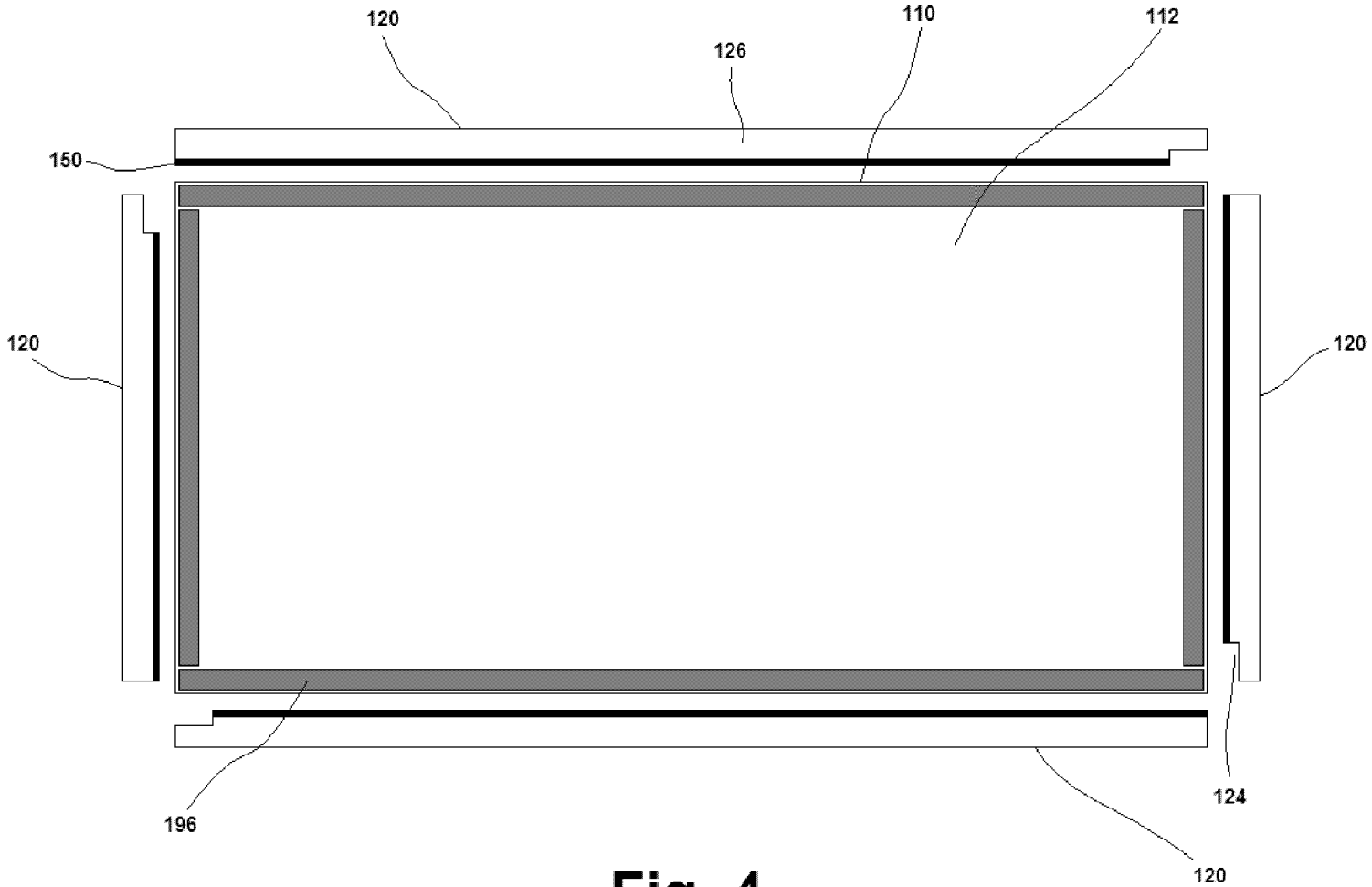
FIG. 4 is a plan top view, exploded, of the improved burial crypt of the present invention, excluding top wall.
Figure 5:
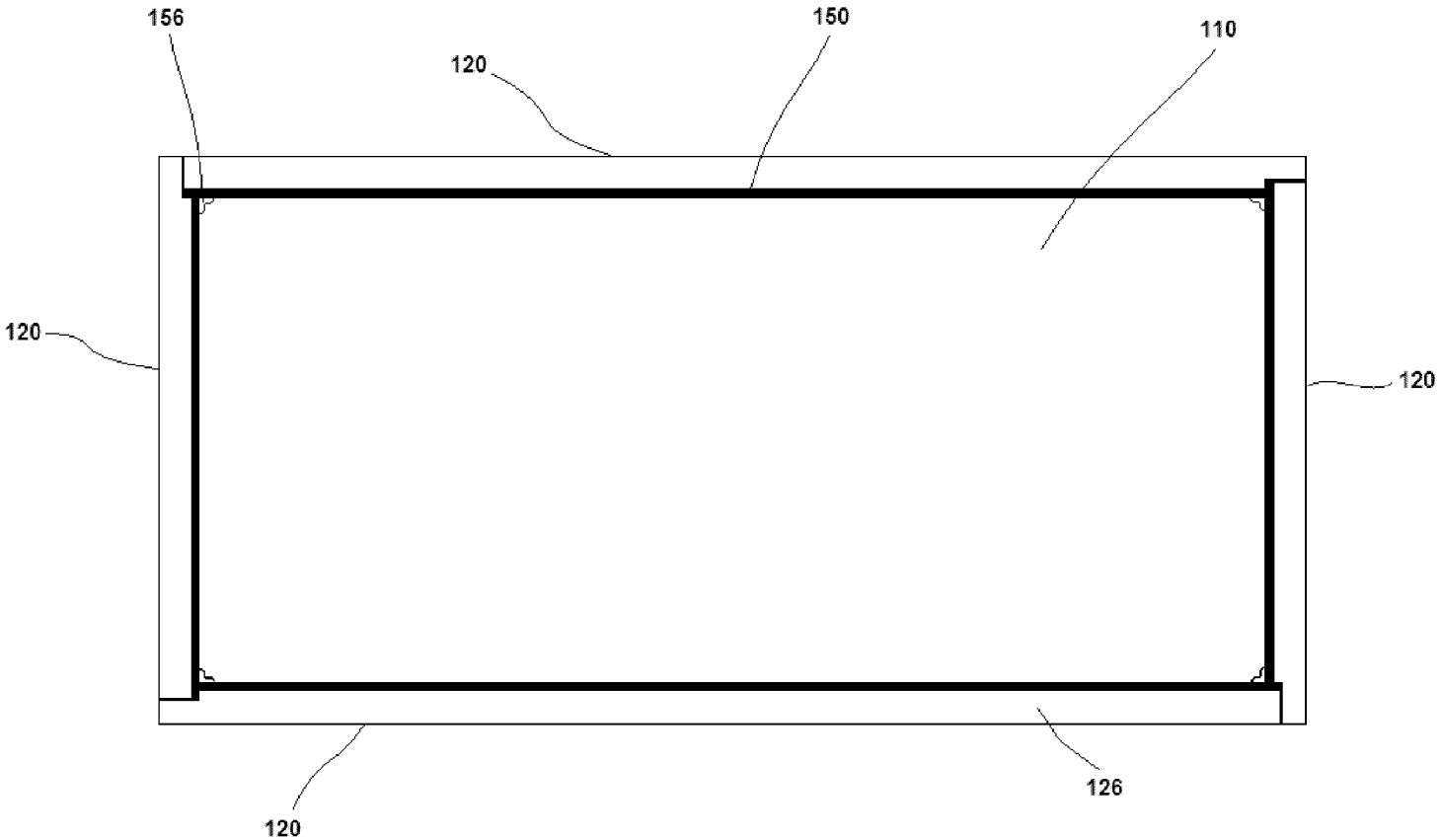
FIG. 5 is a plan top view of the improved burial crypt shown in FIG. 4, with side walls in proper orientation to each other and to floor, excluding top wall.
Figure 6:
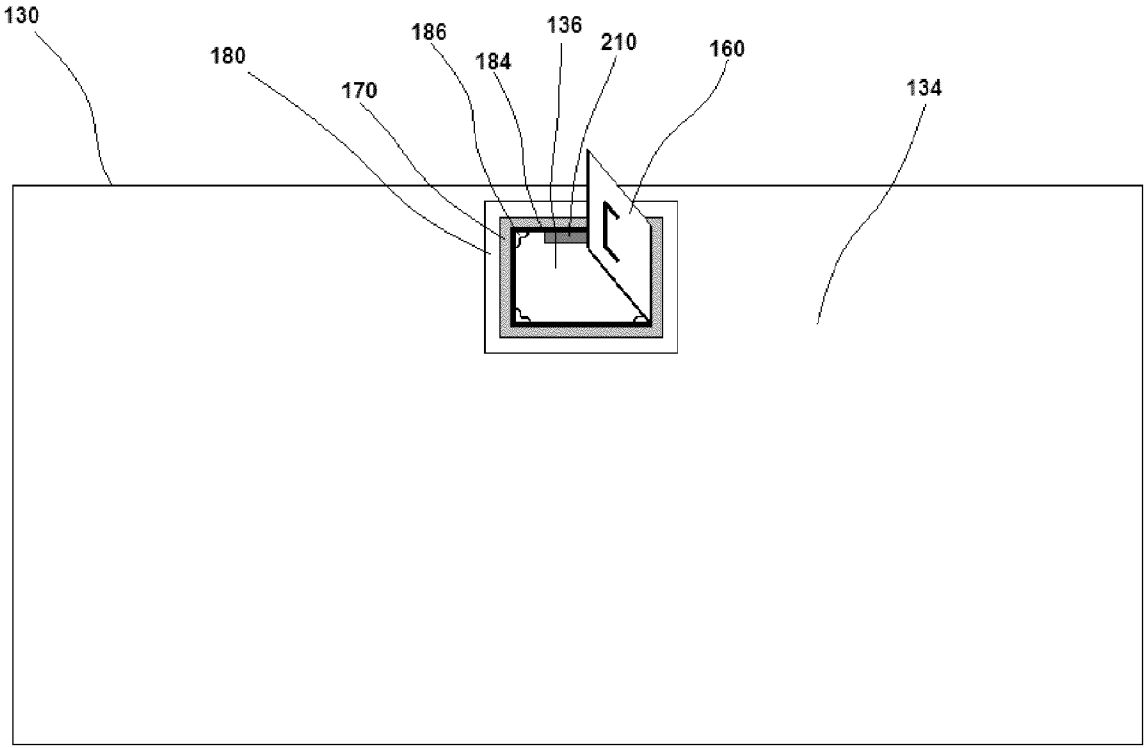
FIG. 6 is a plan top view of the improved burial crypt of the present invention, with top wall in place and depicting riser with partially opened hatch.

The container 100 is comprised of six precast concrete walls 110,120,130 forming an outer shell and enclosing an interior space 140. See FIG. 1. The walls 110, 120, 130 of the container 100 are manufactured off site, then transported to the cemetery and assembled on site. Each of the six walls 110,120,130 is rigid, substantially rectangular, and has a substantially uniform thickness. The thickness of each wall may be between four inches and eighteen inches. The bottom wall, designated the floor 110, is oriented substantially horizontally and has an upper surface 112. The four side walls 120 are placed onto the floor around the perimeter of the floor. See FIGS. 1, 4, and 5. Each of the four side walls 120 is oriented substantially vertically and substantially perpendicular to the floor 110, with a bottom edge placed onto the upper surface 112 of the floor 110. Each side wall 120 of each opposing pair of side walls 120 is dimensioned substantially identically to the other side wall 120 in the pair, and the opposing side walls 120 are oriented substantially parallel to each other. The side walls 120 of each adjacent pair of side walls 120 are substantially perpendicular to each other. Each side wall 120 has an inner surface 122, oriented towards the interior 140 of the container 100. The top wall 130 is oriented substantially horizontally and has substantially the same dimensions as the floor 110. It has an inner surface 132 oriented towards the interior 140 of the container 100 and an outer surface 134. The top wall 130 is positioned onto the four side walls 120 such that the top wall 130 rests upon and is in contact with a top edge 126 of each side wall 120. So positioned, the top wall 130 is substantially parallel with the floor 110. The top wall 130 further comprises an aperture 136, with the aperture 136 passing completely through the top wall 130. See FIG. 6. The aperture 136 is suitably dimensioned to allow a human to pass through the top wall 130 and into the interior 140 of the container 100.

The dimensions of the six walls 110,120,130 comprising the container 100 may be anything suitable for the purpose of fitting the container 100 into either a standard single or double cemetery plot. In the preferred embodiment the floor 110 is between ten and fourteen inches thick; the side walls 120 are between four and twelve inches thick; and the top wall 130 is between ten and fourteen inches thick. In the most preferred embodiment the floor 110 is thirteen and one half inches thick; the side walls 120 are eight inches thick; and the top wall 130 is thirteen and one half inches thick. For a standard single cemetery plot, the floor 110 and top wall 130 are less than ten feet wide by less than twenty feet long; one pair of side walls 120 is less than ten feet wide by less than ten feet tall; and the other pair of side walls 120 is less than twenty feet wide by less than ten feet tall. In the preferred embodiment the floor 110 and top wall 130 are eight feet ten inches wide by eighteen feet ten inches long; one pair of side walls 120 is eight feet wide by eight feet tall; and the other pair of side walls 120 is eighteen feet ten inches wide by eight feet tall. For a standard double cemetery plot, the floor 110 and top wall 130 are less than twenty feet wide by less than twenty feet long; and the four side walls 120 is less than twenty feet wide by less than ten feet tall. In the preferred embodiment the floor 110 and top wall 130 are eighteen feet ten inches wide by eighteen feet ten inches long; and the side walls 120 are each eighteen feet ten inches wide by eight feet tall.

Figures 7A, 7B:
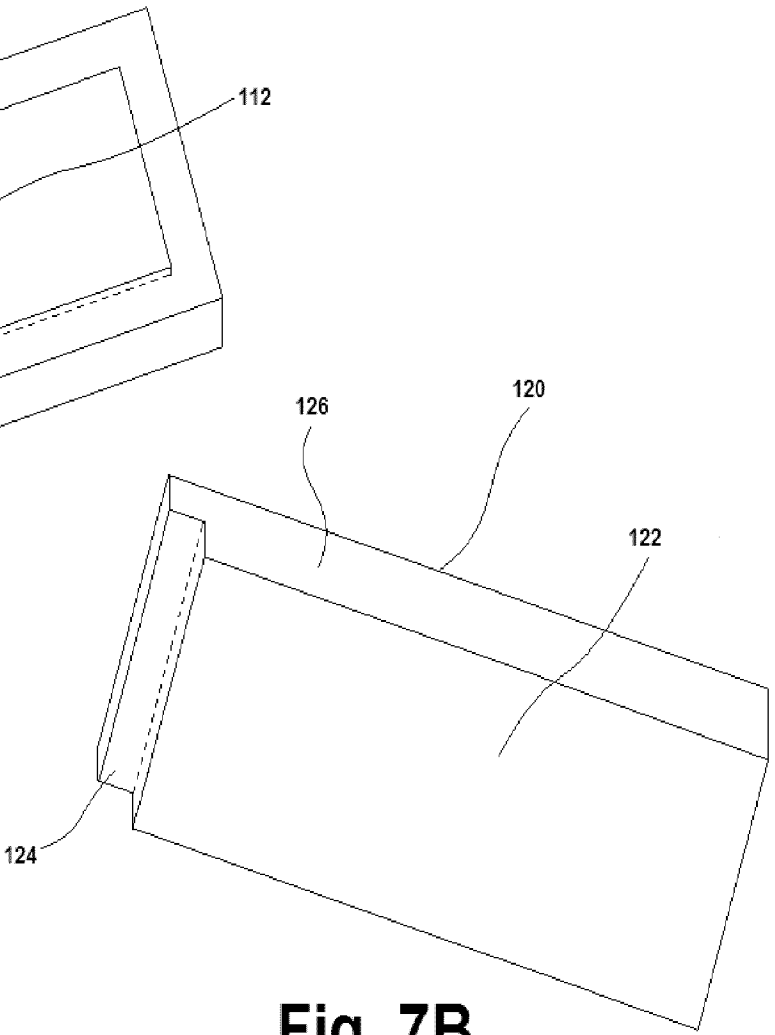
FIG. 7A is a perspective top view of the floor providing detail of the recessed perimeter channel.
FIG. 7B is a perspective side view of a side wall providing detail of the recessed end channel.

In one embodiment of the present invention each side wall 120 has a thickness substantially identical to the thickness of each other side wall 120. In this embodiment the floor 110 may have a recessed perimeter channel 114, with a substantially uniform width measured from the edge of the floor 110 and a substantially uniform depth measured from the upper surface 112 of the floor 110. See FIG. 7A. The width of the perimeter channel 114 of the floor 110 is substantially identical to the thickness of each side wall 120 and the depth of the perimeter channel 114 of the floor 110 is less than one half the thickness of the floor 110. Similarly, the top wall 130 may also have a recessed perimeter channel, with a substantially uniform width measured from the edge of the top wall 130 and a substantially uniform depth measured from the inner surface 132 of the top wall 130. The width of the perimeter channel of the top wall 130 is substantially identical to the thickness of each side wall 120 and the depth of the perimeter channel of the top wall 130 is less than one half the thickness of the top wall 130. In the preferred embodiment, the widths of the recessed perimeter channels of the floor 110 and top wall 130 are eight inches and the depths are one and one half inches. So configured, the bottom edges of the side walls 120 fit into the recessed perimeter channel 114 of the floor 110 and the top edges 126 of the side walls 120 fit into the recessed perimeter channel of the top wall 130. This embodiment allows for easier proper alignment of the walls 110,120,130 when assembling the container 100.

In another embodiment, one end of each side wall 120 has a recessed end channel 124, with a substantially uniform width measured from the edge of the side wall 120 and a substantially uniform depth measured from the inner surface 122 of the side wall 120. See FIG. 7B. The width of the end channel of each side wall 120 is substantially identical to the thickness of each side wall 120 and the depth of the end channel of each side wall 120 is less than one half the thickness of the side wall 120. In the preferred embodiment, the widths of the recessed end channels 124 of the side walls 120 are eight inches and the depths are one and one half inches. So configured, for each side wall 120 the side edge of an adjacent side wall 120 fits into the recessed end channel 124 of that side wall 120. In yet another embodiment the two side walls 120 of one opposing pair of side walls 120 have recessed end channels 124 at both ends, while the two side walls 120 of the other opposing pair have no recessed end channels 124. In this embodiment the side edges of the second pair of opposing side walls 120 fit into the recessed end channels 124 of the first pair of opposing side walls 120. Both of these embodiments allow for easier proper alignment of the side walls 120 with respect to each other when assembling the container 100.

In another embodiment, a sealant 196 is placed between the bottom edge of each side wall 120 and the upper surface 112 of the floor 110. See FIG. 4. Where the floor 110 comprises a recessed perimeter channel 114 the sealant 196 is placed into the recessed perimeter channel 114. In a similar fashion, a sealant 196 may be placed between the top edge 126 of each side wall 120 and the inner surface 132 of the top wall 130. The sealant 196 may be a flexible material, such as Conseal™ CS-102 butyl rubber sealant, manufactured by Concrete Sealants, Inc. In another embodiment the sealant 196 may be comprised of a water impermeable material that is suitably adapted to be applied to substantially the upper surface 112 of the floor 110, whereby the material is fluid during application and thereafter hardens. Spray on foam, epoxies, and the like are examples of this type of sealant 196. Other types of sealants 196 are also contemplated. The use of a sealant 196 improves the water impermeability between the side walls 120 and the floor 110 and between the side walls 120 and the top wall 130.

In addition to the six walls 110,120,130, the container 100 comprises a hatch 160. See FIGS. 2, 3, and 6. The hatch 160 is suitably adapted to engage with the aperture 136 of the top wall 130, such that the hatch 160 can be at least partially removed from the aperture 136 to uncover the aperture 136 to provide access into the interior 140 of the container 100, and to cover the aperture 136 to provide a water tight seal to the container 100. The hatch 160 may be made of any suitable material, such as steel, aluminum, precast concrete, or the like. In the preferred embodiment the hatch 160 is hingedly attached to the top wall 130. In other embodiments the hatch 160 is not attached to the top wall 130 but rather is placed over the aperture 136 and is secured against the top wall 130 by its weight alone. The hatch 160 may comprise a handle 162 for ease of manipulation.

The container 100 is assembled by placing the floor 110 in a substantially horizontal orientation into a hole suitably sized and excavated in advance. A crane or other lifting device may be used to correctly position the floor 110. Once the floor 110 is properly placed into the hole, the four side walls 120 are placed onto the floor 110, each side wall 120 in a substantially vertical orientation. A crane or other lifting device may be used to correctly position each side wall 120 onto the floor 110. The side walls 120 are secured to each other by any appropriate means known in the art. In one embodiment, during fabrication of the side walls 120, steel rebar is cast into each side wall 120, with the ends of the rebar protruding from the edges of the side walls 120, and then steel angle iron weld plates are welded to the ends of the rebar. During assembly, the angle iron weld plates of adjacent side walls 120 are welded to each other, securing the side walls 120 to each other. The weight of the side walls 120 alone secures them against the floor 110. Finally, the top wall 130 is placed in a substantially horizontal orientation onto the top edges 126 of the side walls 120. A crane or other lifting device may be used to correctly position the top wall 130. The weight of the top wall 130 alone secures it against the side walls 120. Once the container 100 is assembled fill 22 is replaced around and over the container 100, with the hatch 160 left exposed. A lawn 24 or other vegetative covering may be planted above the container 100.

The access means 200 of the improved crypt 1 is located proximate to the aperture 136 of the top wall 130, whereby the access means 200 is suitably adapted to allow a human to descend into and ascend out of the interior 140 of the container 100. See FIG. 3. The access means 200 can be any structure suitable for this function. In one embodiment the access means 200 comprises a plurality of steps 210, with each step 210 set into one of the four side walls 120. In this embodiment the steps 210 may be precast concrete formed into the side wall 120 during fabrication, or a metal rung cast into the side wall 120 during fabrication, or a metal rung affixed to the side wall 120 by mechanical fasteners or adhesives after casting of the side wall 120. The steps 210 may be fashioned of other suitable materials, such as composites, plastics, wood, and the like. In an alternative embodiment the access means 200 is a ladder. The ladder may be cast into a side wall 120 during fabrication or affixed to a side wall 120 by mechanical fasteners or adhesives, or it may be free standing. The ladder may be fashioned of any suitable material, including steel, iron, aluminum, composites, wood, plastics, and the like. In yet another embodiment the access means 200 may be a spiral staircase.

The support means 300 of the improved crypt 1 may be any structure suitable for its function. In one embodiment the support means 300 comprises one or more fixed shelves 310. See FIG. 3. The shelves 310 may be made of metal, composite, plastic, wood, or any other suitable material. The shelves 310 may be adjustable. They may be fixed to the container 100 by mechanical fasteners such as screws, lag bolts, pins, and the like. Fixed shelving 310 has the advantage of stability, whereby the risk of the shelves 310 being toppled or otherwise oriented such that they no longer can support the burial urns 10 is reduced. In another embodiment the support means 300 comprises one or more shelving units 320 whereby at least one of the shelving units 320 is movable. The shelving units 320 may be made of metal, composite, plastic, wood, or any other suitable material. The shelves 320 may be adjustable. The movable shelving units 320 may move on tracks. The movable shelving units 320 may be free standing and moved simply by dragging. The movable shelving units 320 may comprise wheels, casters, or the like to facilitate movement. Any other means for facilitating the movement of the movable shelving units 320 is contemplated by the present invention. Movable shelving 320 has the advantage of being able to more efficiently position the support structure to maximize the number of burial urns 10 that can be stored within the container 100. In yet another embodiment tables, benches, or other unilevel structures may be used as support means 300. In yet another embodiment one or more shelves 310 may be integrated into the side walls 120 of the container 100, or affixed thereto with mechanical fasteners.

In one embodiment of the improved subterranean crypt 1 of the present invention, the interior 140 of the container 100 is lined with a liner 150. See FIG. 5. The liner 150 is suitably adapted to cover substantially the entire upper surface 112 of the floor 110, substantially the entire inner surface 122 of each side wall 120, and substantially the entire inner surface 132 of the top wall 130. The primary function of the liner 150 is to provide a water tight container 100. In one embodiment the liner 150 may be comprised of a water impermeable material that is suitably adapted to be applied to substantially the entire interior surface of the container 100, whereby the material is fluid during application and thereafter hardens.

Figure 8A:
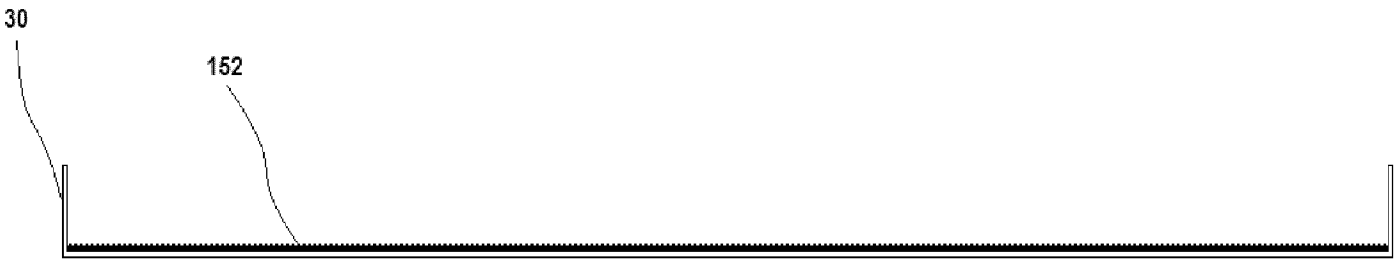
FIG. 8A is a plan side view of a form used to make the precast walls, with one embodiment of the liner placed therein before the concrete is added.
Figure 8B:
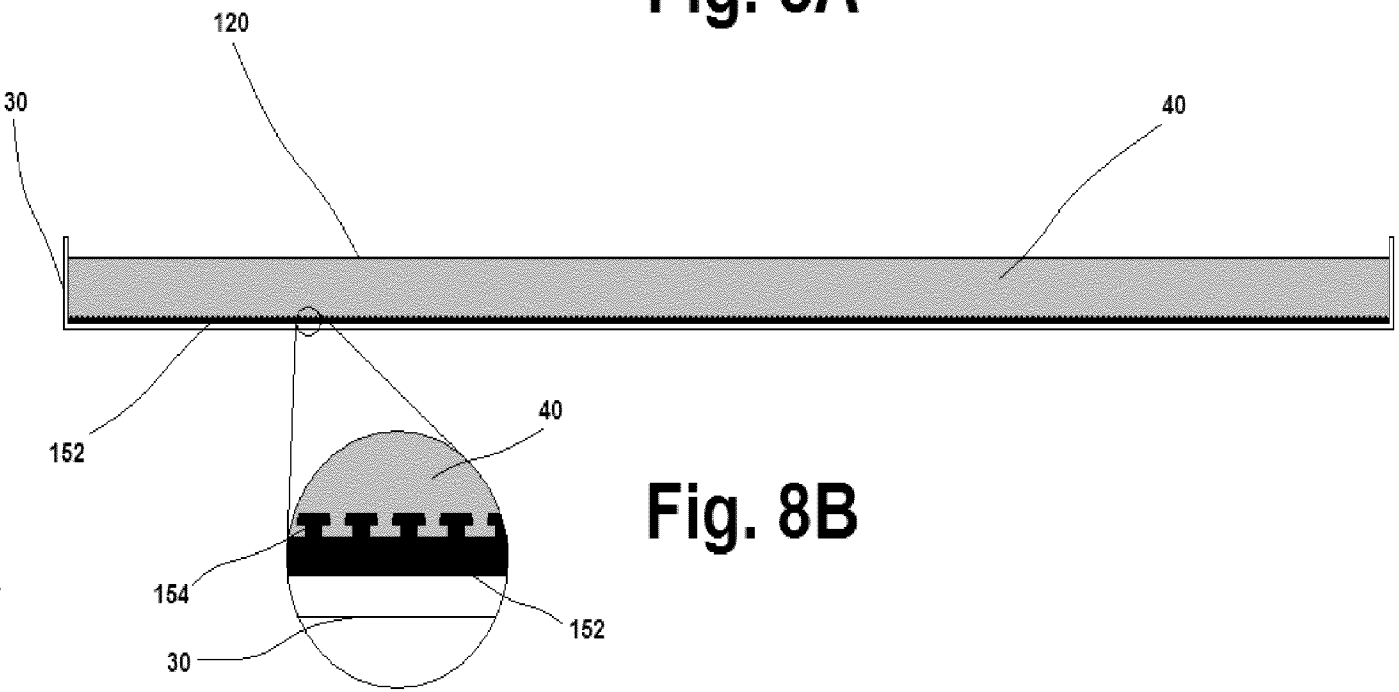
FIG. 8B is the same view as FIG. 8A after the concrete is added, with a close up view of the interlocking projections of the liner embedded into the concrete.

In the preferred embodiment, the liner 150 is comprised of a plurality of panels 152, with each panel 152 placed against and affixed to the bottom, side, or top wall 130. In this embodiment each panel 152 is substantially planar and substantially flexible and has an inner surface and an outer surface, with the inner surface placed against a wall 110,120,130 and the outer surface oriented towards the interior 140 of the container 100. A plurality of panels 152 may be affixed to each wall 110,120,130. In one embodiment the inner surface of each panel 152 may comprise a plurality of projections 154 suitably adapted to be set into one of the walls 110,120,130, thereby securing the panel 152 to the wall 110,120,130. In such an embodiment the panel 152 is cast onto the wall 110,120,130 during fabrication. See FIGS. 8A and 8B. Such panels 152 may be constructed of a high density polyethylene material. One example of such a panel 152 is the GSE Studliner™, manufactured by GSE Lining Technology, LLC. During fabrication, a panel 152 of the liner 150 is placed into a form 30, projection side up. See FIG. 8A. Concrete 40 is then poured into the form 30 onto the panel 152. The concrete 40 flows around the projections 154. See FIG. 8B. Once the concrete 40 hardens the wall 110,120,130 is removed from the form 30, with the panel 152 bonded thereto. In another embodiment the panel 152 may be secured to a wall 110,120,130 by an adhesive, where by the adhesive placed between the inner surface of the panel 152 and the inner surface 112,122,132 of the wall 110,120,130. In yet another embodiment the panel 152 may be secured to a wall 110,120,130 by mechanical fasteners. In yet another embodiment the panels 152 may be substantially rigid. In yet another embodiment the liner 150 may be a combination of panels 152 and water impermeable material, whereby the water impermeable material is applied over those portions of the walls 110,120,130 not otherwise covered by the panels 152.

The seams between adjacent panels 152 may be sealed to increase the water impermeability of the container 100. In one embodiment each seam between adjacent panels 152 is covered by a seam strip 156, then each seam strip 156 is heat welded to the adjacent panels 152. See FIG. 5. The seam strips 156 may be constructed of a high density polyethylene material. In other embodiments the seams between adjacent panels 152 may be sealed by a water impermeable material that is fluid during application and thereafter hardens, such as a spray on foam, an epoxy, and the like.

In those embodiments utilizing a liner 150 comprised of panels 152, the access means 200 may be a plurality of steps 210 affixed to the one or more panels 152 attached to one of the four side walls 120. The steps 210 may be affixed by mechanical fasteners or by adhesives. In another embodiment the steps 210 may be formed onto the outer surface of the one or more panels 152. In yet another embodiment the steps 210 may be inserted through the one or more panels 152 and affixed to the wall.

The improved subterranean crypt 1 of the present invention may further comprise a frame 170 affixed to the aperture 136 of the top wall 130. The frame 170 is used to support the hatch 160 to provide for better operation of the hatch 160 and a more secure seal when the hatch 160 is closed. See FIG. 6. In the preferred embodiment the hatch 160 is hingedly attached to the frame 170. The frame 170 may be cast into the top wall 130 during fabrication. In other embodiments it may be secured to the perimeter of the aperture 136 by mechanical fasteners or by adhesives. It may be made of aluminum, steel, composites, plastics, or other suitable materials.

In yet another embodiment the improved subterranean crypt 1 further comprises a riser 180. See FIG. 1. The riser 180 is located on the outer surface 134 of the top wall 130 and is positioned over the aperture 136. See FIG. 6. It has an open top end 182 and an open bottom end and a substantially hollow interior, thereby permitting a human to enter the interior of the riser 180 through the top end 182 and to access the aperture 136 through the bottom end of the riser 180. The riser 180 is suitably adapted to extend at least partially above grade 20 when the container 100 is properly installed on site. This allows the majority portion of the crypt 1 to be buried while still providing above-grade access to the interior 140 of the container 100.

In one embodiment the riser 180 is substantially rectangular. In another embodiment the riser 180 may be substantially cylindrical. Other configurations of the riser 180 are also contemplated. The riser 180 may be affixed to the outer surface 134 of the top wall 130 by mechanical fasteners or by adhesives. In the preferred embodiment the riser 180 is cast into the top wall 130 during fabrication. This results in a seamless integration between the riser 180 and the top wall 130. If a frame 170 is used, the frame 170 may be affixed to the top end 182 of the riser 180. In the preferred embodiment the frame 170 is cast into the top end 182 of the riser 180.

The riser 180 may also be lined. In the preferred embodiment the riser liner 184 is comprised of a plurality of riser panels. See FIG. 6. Each riser panel may be of the same type of material as the liner panels 152 affixed to the walls 110, 120,130. Seams between adjacent riser panels may be covered by riser seam strips 186, with each riser seam strip 186 being heat welded to the adjacent riser panels. See FIG. 6. In another embodiment the riser liner 184 may be comprised of a water impermeable material that is suitably adapted to be applied to substantially the entire interior surface of the riser 180, whereby the material is fluid during application and thereafter hardens.

In yet another embodiment the improved subterranean crypt 1 further comprises an insulating layer 190 affixed to the outer surface 134 of the top wall 130. The insulating layer 190 may be made of a Styrofoam™ material. In a variant the insulating material 190 may extend down the sides of the container 100, covering at least an upper portion of each side wall 120. See FIG. 2. By providing an insulating layer 190 to the upper portions of the crypt 1 the likelihood of damage or displacement as a result of frost heaving in the winter months is lessened. Due to the depth the container 100 is buried, no insulating layer 190 is needed along the lower portions of the container 100, as such would be located below the frost line.

The improved subterranean crypt 1 may also comprise an aesthetic covering, whereby at least a portion of the inner surface 122 of one or more of the side walls 120 of the container 100 is covered with the aesthetic covering. Alternatively, the upper surface 112 of the floor 110 and/or the inner surface 132 of the top wall 130 may also be covered with an aesthetic covering. The aesthetic covering may be a type of wood paneling, or wall paper, or tapestry, or carpeting, or tiles, or paint, or any other type of covering which may render the interior 140 of the container 100 more aesthetically pleasing. The aesthetic covering is affixed to the walls 110,120,130 by any known and suitable means. Where the container 100 comprises a liner 150, the aesthetic covering would cover at least a portion of the liner 150.

The present invention also discloses a method of constructing the improved subterranean crypt 1. The method comprising the following steps:

A. fabricating components of a container 100 at a site located distant from the final location of the improved subterranean crypt 1, said container 100 being sealable, substantially water tight, and suitably adapted to be placed substantially below grade, said container 100 formed of precast concrete, said container 100 comprising a floor 110, four side walls 120, and a top wall 130, said top wall 130 comprising an aperture 136, said aperture 136 passing completely through said top wall 130 and being suitably dimensioned to allow a human to pass therethrough;

B. transporting the components of the container 100 to the final location of the improved subterranean crypt 1;

C. placing the components of the container 100 into an excavated site, beginning with the floor 110 and followed by the side walls 120;

D. partially assembling the components of the container 100 within the excavated site by properly positioning the side walls 120 onto the floor 110 such that each side wall 120 is oriented substantially vertically and substantially perpendicular to the floor 110, with each side wall 120 positioned onto said floor 110 along an edge of said floor 110 and adjacent to and in contact with two other side walls 120, and then securing each adjacent pair of side walls 120 to each other;

E. placing within the interior 140 of the container 100 an access means 200, said access means 200 suitably adapted to allow a human to descend into and ascend out of said interior 140 of said container 100;

F. placing within the interior 140 of the container 100 a support means 300, said support means 300 suitably adapted to support a plurality of burial urns 10;

G. further assembling the components of the container 100 within the excavated site by placing the top wall 130 onto the four side walls 120 such that said top wall 130 rests upon and is in contact with a top edge 126 of each said side wall 120;

H. further assembling the improved subterranean crypt 1 by affixing a hatch 160 to the top wall 130, said hatch 160 suitably adapted to be at least partially removed from said aperture 136 to provide access into said interior 140 of said container 100, and to cover said aperture 136 to provide a water tight seal; and I. providing fill 22 around and onto the improved subterranean crypt 1 until it is buried substantially below grade 20.

Steps A through I are performed in sequential order except that step F may be performed either before or after step E.

Optionally, the method may further comprise the following substeps of attaching a liner 150 to substantially an entire upper surface 112 of the floor 110; attaching a liner 150 to substantially an entire inner surface 122 of each said side wall 120; and attaching a liner 150 to substantially an entire inner surface 132 of said top wall 130.

In other embodiments of the method a sealant 196 is placed between a bottom edge of each side wall 120 and the floor 110; a sealant 196 is placed between a top edge 126 of each side wall 120 and the top wall 130; and an insulating layer 190 is placed onto an outer surface 134 of the top wall 130.

What has been described and illustrated herein is a preferred embodiment of the invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are therefore also within the scope of the following claims.

I claim:

1. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall, with said interior lined with a liner, said liner being suitably adapted to cover substantially the entire upper surface of said floor, substantially the entire inner surface of each said side wall, and substantially the entire inner surface of said top wall, said liner being comprised of a plurality of panels, each said panel being substantially planar and substantially flexible and having an inner surface and an outer surface, with said inner surface of each said panel being suitably adapted to being placed against and affixed to one of the following: the upper surface of said floor, the inner surface of each said side wall, and the inner surface of said top wall; with the outer surface of each said panel oriented towards the interior of said container, each said panel being constructed of a high density polyethylene material, and each seam between adjacent panels being covered by a seam strip, each said seam strip being heat welded to said adjacent panels; and a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

2. The subterranean crypt of claim 1 wherein each said seam strip is constructed of a high density polyethylene material.

3. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall, with said interior lined with a liner, said liner being suitably adapted to cover substantially the entire upper surface of said floor, substantially the entire inner surface of each said side wall, and substantially the entire inner surface of said top wall, said liner being comprised of a plurality of panels, each said panel being substantially planar and substantially flexible and having an inner surface and an outer surface, with said inner surface of each said panel being suitably adapted to being placed against and affixed to one of the following: the upper surface of said floor, the inner surface of each said side wall, and the inner surface of said top wall; with the outer surface of each said panel oriented towards the interior of said container, each said panel being constructed of a high density polyethylene material, and seams between adjacent panels are heat welded; and a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

4. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall;

a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal; and a riser, said riser being substantially rectangular, with an open top end and an open bottom end and a substantially hollow interior, said riser located on the outer surface of said top wall and positioned over the aperture of said top wall, said riser suitably adapted to extend at least partially above grade, whereby said riser is suitably adapted to allow a human to enter the interior of said riser through the top end of said riser and to access the aperture of the top wall through the bottom end of said riser, with said riser being cast into the top wall;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

5. The subterranean crypt of claim 4 wherein a frame is cast into the top end of said riser, whereby said hatch is hingedly attached to said frame.

6. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall;

a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal; and a riser, said riser being substantially rectangular, with an open top end and an open bottom end and a substantially hollow interior, said riser located on the outer surface of said top wall and positioned over the aperture of said top wall, said riser suitably adapted to extend at least partially above grade, whereby said riser is suitably adapted to allow a human to enter the interior of said riser through the top end of said riser and to access the aperture of the top wall through the bottom end of said riser, wherein a frame is cast into the top end of said riser, whereby said hatch is hingedly attached to said frame;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

7. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall;

a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal; and a riser, said riser being substantially rectangular, with an open top end and an open bottom end and a substantially hollow interior, said riser located on the outer surface of said top wall and positioned over the aperture of said top wall, said riser suitably adapted to extend at least partially above grade, whereby said riser is suitably adapted to allow a human to enter the interior of said riser through the top end of said riser and to access the aperture of the top wall through the bottom end of said riser, wherein said riser is lined;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

8. The subterranean crypt of claim 7 wherein said riser liner is comprised of a plurality of riser panels, each said riser panel being substantially planar and substantially flexible and having an inner surface and an outer surface, with said inner surface of each said riser panel being suitably adapted to being placed against and affixed to a surface of the interior of said riser; with the outer surface of each said riser panel oriented towards the interior of said riser.

9. The subterranean crypt of claim 8 wherein each seam between adjacent riser panels is covered by a riser seam strip, each said riser seam strip being heat welded to said adjacent riser panels.

10. The subterranean crypt of claim 9 wherein each said riser seam strip is constructed of a high density polyethylene material.

11. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall;

a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal; and a riser, said riser being substantially cylindrical, with an open top end and an open bottom end and a substantially hollow interior, said riser located on the outer surface of said top wall and positioned over the aperture of said top wall, said riser suitably adapted to extend at least partially above grade, whereby said riser is suitably adapted to allow a human to enter the interior of said riser through the top end of said riser and to access the aperture of the top wall through the bottom end of said riser, wherein said riser is lined;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

12. The subterranean crypt of claim 11 wherein said riser liner is comprised of one or more riser panels, each said one or more riser panels being substantially planar and substantially flexible and having an inner surface and an outer surface, with said inner surface of each said one or more riser panels being suitably adapted to being placed against and affixed to a surface of the interior of said riser; with the outer surface of each said one or more riser panels oriented towards the interior of said riser.

13. The subterranean crypt of claim 12 wherein each seam between adjacent riser panels is covered by a riser seam strip, each said riser seam strip being heat welded to said adjacent riser panels.

14. The subterranean crypt of claim 13 wherein each said riser seam strip is constructed of a high density polyethylene material.

15. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an interior, said interior formed by said floor, said four side walls, and said top wall; and a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal; and a frame, said frame being cast into the aperture of said top wall, whereby said hatch is hingedly attached to said frame;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

16. A subterranean crypt comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top floor oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough, wherein said top wall of said container further comprises an insulating layer affixed to the outer surface of said top wall;

an interior, said interior formed by said floor, said four side walls, and said top wall; and a hatch, said hatch suitably adapted to engage with said aperture of said top wall, said hatch being suitably adapted to be at least partially removed from said aperture to uncover said aperture to provide access into said interior of said container, and to cover said aperture to provide a water tight seal;

an access means, said access means located within said interior of said container and further located proximate to said aperture of said top wall, whereby said access means is suitably adapted to allow a human to descend into and ascend out of said interior of said container; and a support means, said support means located within said interior of said container and suitably adapted to support a plurality of burial urns.

17. The subterranean crypt of claim 16 wherein said insulating layer is made of a Styrofoam material.

18. A subterranean crypt, comprising a container, said container being sealable, substantially water tight, and suitably adapted to be placed substantially below grade, said container comprising a floor, said floor being substantially rectangular and formed of precast concrete, said floor further having a substantially uniform thickness and an upper surface, with said floor oriented substantially horizontally;

four side walls, each said side wall being substantially rectangular and formed of precast concrete, each said side wall further having a substantially uniform thickness and an inner surface, with each said side wall oriented substantially vertically and substantially perpendicular to the floor, with each said side wall positioned onto said floor along an edge of said floor and adjacent to and in contact with two other side walls, with both side walls of each opposing pair of side walls having substantially the same dimensions;

a top wall, said top wall being substantially rectangular and having substantially the same dimensions as said floor, said top wall being formed of precast concrete, said top floor further having a substantially uniform thickness, an inner surface, and an outer surface, with said top wall oriented substantially horizontally, with said top wall being positioned onto the four side walls such that said top wall rests upon and is in contact with a top edge of each said side wall, with said top wall further comprising an aperture, said aperture passing completely through said top wall, said aperture suitably dimensioned to allow a human to pass therethrough;

an insulating layer, wherein said insulating layer is made of a Styrofoam material and is affixed to the outer surface of said top wall;

a sealant, wherein said sealant is placed between a bottom edge of each side wall and the floor and between the top edge of each side wall and the top wall;

an interior, said interior formed by said floor, said four side walls, and said top wall;

a liner, said liner suitably adapted to cover substantially the entire upper surface of said floor, substantially the entire inner surface of each said side wall, and substantially the entire inner surface of said top wall, said liner comprised of a plurality of panels, each said panel being substantially planar and substantially flexible and having an inner surface and an outer surface, with said inner surface of each said panel being suitably adapted to being placed against and affixed to one of the following: the upper surface of said floor, the inner surface of each said side wall, and the inner surface of said top wall; with the outer surface of each said panel oriented towards the interior of said container, with the inner surface of each said panel comprising a plurality of projections suitably adapted to be set into one of the upper surface of said floor, the inner surface of each said side wall, and the inner surface of said top wall, thereby securing said panel to said respective wall or floor, wherein each said panel is constructed of a high density polyethylene material, and seams between adjacent panels are covered by seam strips which are heat welded to said adjacent panels;

a riser, said riser being substantially rectangular with an open top end and an open bottom end and a substantially hollow interior, said riser located on the outer surface of said top wall and positioned over the aperture of said top wall, said riser suitably adapted to extend at least partially above grade, wherein said riser is cast into the top wall and said riser is lined, whereby said riser is suitably adapted to allow a human to enter the interior of said riser through the top end of said riser and to access the aperture of the top wall through the bottom end of said riser; and a hatch, said hatch suitably adapted to engage with said riser, said hatch being suitably adapted to be at least partially removed from said riser to uncover said aperture to provide access into said interior of said container, and to cover said aperture to provide a water tight seal, wherein a frame is cast into the top end of said riser, with said hatch being hingedly attached to said frame;

an access means, said access means located within said interior of said container and further located proximate to said aperture of said top wall, whereby said access means is suitably adapted to allow a human to descend into and ascend out of said interior of said container, wherein said access means comprises a plurality of steps, each said step set into one of the four side walls; and a support means, said support means located within said interior of said container and suitably adapted to support a plurality of burial urns, wherein said support means comprises one or more shelving units whereby at least one of said shelving units is movable.

19. A method of constructing a subterranean crypt, said method comprising the following steps:

A. fabricating components of a container at a site located distant from the final location of the improved subterranean crypt, said container being sealable, substantially water tight, and suitably adapted to be placed substantially below grade, said container formed of precast concrete, said container comprising a floor, four side walls, and a top wall, said top wall comprising an aperture, said aperture passing completely through said top wall and being suitably dimensioned to allow a human to pass therethrough;

B. transporting the components of the container to the final location of the improved subterranean crypt;

C. placing the components of the container into an excavated site, beginning with the floor and followed by the side walls;

D. partially assembling the components of the container within the excavated site by properly positioning the side walls onto the floor such that each side wall is oriented substantially vertically and substantially perpendicular to the floor, with each side wall positioned onto said floor along an edge of said floor and adjacent to and in contact with two other side walls, and then securing each adjacent pair of side walls to each other;

E. placing within the interior of the container an access means, said access means suitably adapted to allow a human to descend into and ascend out of said interior of said container;

F. placing within the interior of the container a support means, said support means suitably adapted to support a plurality of burial urns;

G. further assembling the components of the container within the excavated site by placing the top wall onto the four side walls such that said top wall rests upon and is in contact with a top edge of each said side wall;

H. further assembling the improved subterranean crypt by affixing a hatch to the top wall, said hatch suitably adapted to be at least partially removed from said aperture to provide access into said interior of said container, and to cover said aperture to provide a water tight seal; and I. providing fill around and onto the improved subterranean crypt until it is buried substantially below grade;

wherein steps A through I are performed in sequential order except that step F may be performed either before or after step E.

20. The method of claim 19 further comprising one or more of the following substeps:

A1. attaching a liner constructed of a high density polyethylene material to substantially an entire upper surface of the floor;

A2. attaching a liner constructed of a high density polyethylene material to substantially an entire inner surface of one or more of said side walls;

A3. attaching a liner constructed of a high density polyethylene material to substantially an entire inner surface of said top wall;

C1. placing a sealant between a bottom edge of each side wall and the floor;

D1. placing a sealant between a top edge of each side wall and the top wall; and G1. placing an insulating layer onto an outer surface of the top wall;

with substeps A1, A2, and A3 being performed in any order and after the fabrication of the respective components of the container in step A, and before step B;

substep C1 being performed after step C and before step D;

substep D1 being performed after step D and before step G; and substep G1 being performed after step G and before step I.

* * * * *